United States Patent [19]

Gasser

[11] Patent Number: 4,757,662

[45] Date of Patent: Jul. 19, 1988

[54] MEMBRANE ROOFING FASTENER

[75] Inventor: David A. Gasser, Wooster, Ohio

[73] Assignee: G.B.R. Enterprises, Wooster, Ohio

[21] Appl. No.: 12,388

[22] Filed: Feb. 9, 1987

[51] Int. Cl.[4] ..... E04B 5/00

[52] U.S. Cl. ..... 52/410; 52/512; 52/713; 411/372; 411/531; 411/542; 24/459

[58] Field of Search ..... 52/222, 309.1, 410, 52/506, 512, 713; 24/459, 462, 461; 160/399, 402; 411/368, 369, 372, 373, 375, 508–510, 531, 533, 542

[56] References Cited

U.S. PATENT DOCUMENTS

| | | | |
|---|---|---|---|
| 3,426,412 | 2/1969 | Streng et al. | 24/461 |
| 4,221,028 | 9/1980 | Fischer | 24/457 |
| 4,502,256 | 3/1985 | Hahn | 52/63 |
| 4,519,175 | 5/1985 | Resan | 52/713 |
| 4,624,092 | 11/1986 | Baginski | 52/713 |
| 4,631,887 | 12/1986 | Francovitch | 52/410 |
| 4,651,490 | 3/1987 | Marston | 52/410 |
| 4,660,347 | 4/1987 | Resan | 52/713 |

FOREIGN PATENT DOCUMENTS

| | | | |
|---|---|---|---|
| 929176 | 6/1963 | United Kingdom | 411/369 |

*Primary Examiner*—John E. Murtagh
*Assistant Examiner*—Andrew Joseph Rudy
*Attorney, Agent, or Firm*—Oldham, Oldham & Weber Co.

[57] ABSTRACT

A roofing fastener is shown adapted to fasten membrane roofing film to roofing structures. The fastener comprises a base plate having a segmented upper, tapered circular flange section; a segmented middle circular ring locking section; and a lower base section. After attaching the base plate to the roofing structure by means of a fastener inserted through an axial hole located in the center of the base plate, and an annular snap ring having an internal diameter just large enough to fit over the film covered base plate when the segments of the base plate are compressed, is forced over the film covered base plate, and adjacent to the locking section, thereby locking the roofing film in place.

7 Claims, 2 Drawing Sheets

MEMBRANE ROOFING FASTENER

This invention relates to roofing structures. More particularly, this invention relates to single-ply roofing systems of the type involving installation of a membrane formed from suitable elastomeric material over a roofing substrate. Specifically, this invention relates to fasteners suitable for attaching single-ply roofing membranes to roofing substrates comprising a snap ring which can be forced over a membrane covered, resiliently segmented, fastener base component, previously fastened to a roofing structure substrate, thereby securely locking the snap ring and the interposed membrane to the base, and therefore, to the roofing structure.

BACKGROUND ART

Single-ply roofing systems have enjoyed great popularity due to their ease of installation, durability, and related advantages. Such roofing systems involve the installation of any of various elastomeric membranes such as EPDM, i.e., ethylene/propolyene/diene terpolymers, polyisobutylene, neoprene, and the like over roofing substrates which may include those formed from concrete, insulation board, sheet metal, and other materials.

In the past, such membranes have been installed by being covered with ballast, such as gravel, by the use of adhesives, and by having fasteners driven through the membrane into the underlying substrate. Such methods have obvious disadvantages. The use of ballast, for example, entails excessive roof loadings, while adhesive attachment involves a time-consuming, labor intensive, expensive operation. The use of fasteners destroys the seal of the roof, and leaks are difficult to control, notwithstanding attempts to provide waterproof sealing. Such problems have given rise to a number of attempts to provide roofing fasteners which do not compromise the weather integrity of roofing systems. Typical of such devices is that shown in U.S. Pat. No. 4,519,175 which includes an anchoring disc with a frusto-conical projection which is screwed or nailed on the roof's surface, following which an externally threaded, tined retainer cap is snapped thereover, fastening an interposed membrane to the disc. In a final step, an internally threaded cover is screwed over the retainer cap, locking the cap and thus the membrane to the roof. Such a system, however, has the drawback of involving a relatively large number of intricately shaped parts. Furthermore, as the parts multiply, so do the operations necessary for their installation, resulting in increased installation time and the expense connected therewith. Still another approach is that taught in U.S. Pat. No. 4,502,256, in which a two-part clamping system is taught involving a projecting stem member fastened to the roof over which a component whose operative member comprises a steel spring ring is snapped, fastening an interposed membrane to the roof. Although the latter system requires fewer components than does the former device, the nature of the spring ring connection and its counterpart stem component makes it susceptible to dislodgement, particularly in high wind conditions, when roof membranes are subjected to flutter. The exposed sharp ends of the spring ring also make accidental puncture of the membrane a distinct possibility.

DISCLOSURE OF THE INVENTION

In light of the foregoing, it is a first aspect of the invention to provide fasteners for single-ply roofs which can be installed without penetrating the roof membrane;

it is a second aspect of the invention taught herein to provide a membrane roofing fastener with a superior locking mechanism;

another aspect of this invention is the provision of a membrane roofing fastener, the base member of which has a reduced tendency to cup, and dislodge the fastening component;

a further aspect of the invention disclosed is to make available simplified membrane roofing fasteners with a minimum number of components;

a still further aspect of the invention is to provide a fastener which can be assembled with a minimal number of operations;

yet another aspect of the invention is to furnish a membrane roofing fastener which has a low profile, and therefore, reduces the possibility of wind damage;

another aspect of the invention is to provide a tool which makes assembly of the membrane roofing fasteners quick and easy to accomplish;

these and other aspects are provided by a membrane roofing fastener comprising:

a base plate, and a snap ring, said base plate comprising a monolithic structure having a segmented, upper, tapered, circular flange section, a segmented, middle, circular ring locking section, and a lower base section, said base plate having an axial hole therein, the lower part thereof having a smaller diameter than the upper part thereof, and said snap ring comprising a flat ring having a rounded internal edge, the internal diameter of said snap ring being just large enough to fit over said flange section when the latter is compressed and covered with a roofing membrane, but not large enough to so fit when said flange section is not compressed;

still other aspects of the invention are provided by a membrane roofing assembly in which an elastomeric roofing membrane is fastened to a roof using membrane roofing fasteners in accordance with the preceding paragraph;

still further aspects of the invention are realized by an installation tool for use with the membrane fastener described above comprising:

a cylindrical piston member;

a tubular handle member, and a spring, said tubular handle having an annular handle sleeve extending from the lower end thereof, wherein said piston member, which has a locating nipple on its face, is slideably positioned in the open lower end of said tubular handle member, extending into said annular sleeve, and wherein said piston member is urged toward said lower end by spring means located in said tubular handle member, but whose downward movement is limited by retainer means, said piston member being free to slide upward in said tubular handle member when impelled by the force created as the tool is pushed downward over the membrane covered flange section of the membrane fastener, and wherein the internal diameter of said annular handle sleeve is large enough to fit over the membrane covered flange section of said membrane fastener, but not over its snap ring.

BRIEF DESCRIPTION OF THE DRAWINGS

The invention described herein will be better understood when reference is had to the drawings herein, in which like parts are designated by the same number, and in which:

FIG. 5 is a top view of a membrane installed on a roofing structure with the roofing fasteners of the invention;

BEST MODE FOR CARRYING OUT THE INVENTION

Figure 1:
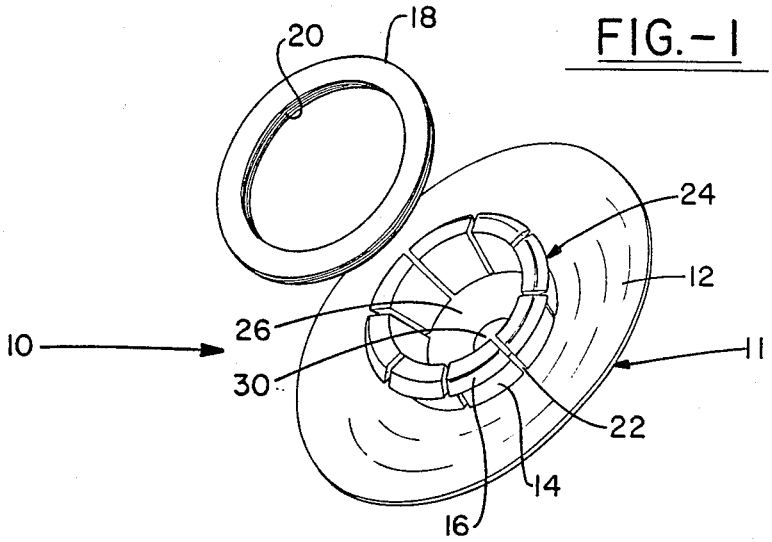
FIG. 1 is an isometric view of a base plate and its associated snap ring.

FIG. 1 shows an isometric view of a membrane roofing fastener indicated generally by 10 and including a base plate indicated generally by 11, and snap ring 18. As shown in the Figure, base plate 11 comprises a lower base section 12, a middle ring locking section 14, and an upper flange section 16, all such sections forming a unitary, monolithic structure. The base plate 11 contains an axial hole, the upper end of which has a larger diameter than the lower end so as to form a ledge seat 26. The purpose of the hole is to provide access for an anchor fastener, required to attach the base plate to the roofing structure. Both the ring locking section 14 and flange section 16 have slots 22 cut therein, dividing such sections into segments, indicated generally by 24. Associated with base plate 11, and used in conjunction therewith, is a snap ring 18, a flat ring having a rounded internal or "bull-nose" edge 20. The fastener is used by securing the base section 12 to the roofing structure by means of an anchor fastener inserted through the axial hole of the base plate. A roofing membrane is disposed over base plate 12, and the snap ring is positioned on the membrane, over flange section 16. The snap ring 18 is then forced downward, compressing the segments 24 inwardly, so as to permit the snap ring to pass downwardly over the tapered edge of the flange section to ring locking section 14. After the snap ring 18 has passed over flange section 16, the segments 24 spring back to their uncompressed position, effectively locking the membrane in place. Should it become necessary, the procedure can be reversed to unlock roofing fastener 10.

Base plate 11 and snap ring 18 may be made from any of various materials such as plastic, hard rubber, and similar materials; however, plastic, including such compositions as nylon, teflon, PVC, ABS, and others have been found to be particularly useful. If desired, the snap ring may be fabricated from some appropriate metal such as stainless steel. When fashioned from plastic, base plate 11 and snap ring 18 may conveniently be made by injection molding.

Figure 2:
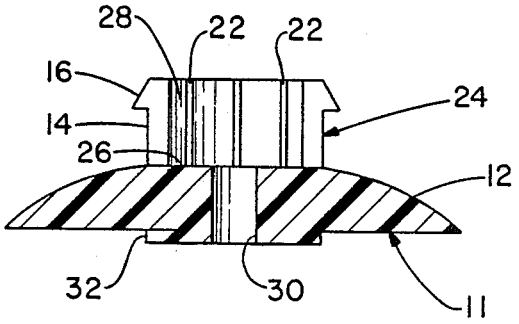
FIG. 2 is a sectional view of the base plate of the invention along line 2—2 of FIG. 3.
Figure 3:
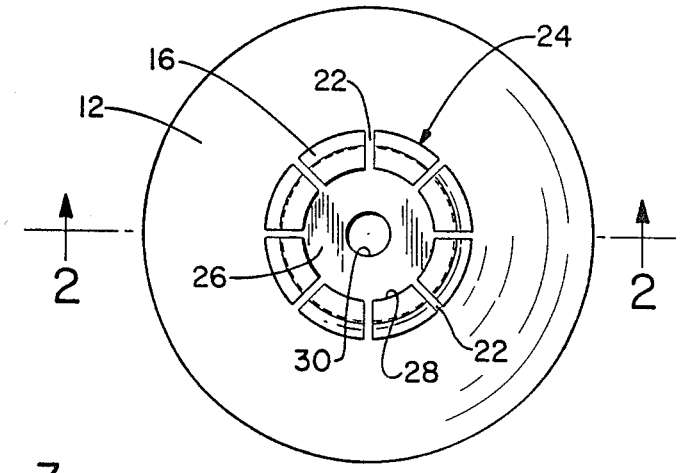
FIG. 3 is a top view of the base plate of the invention.

FIG. 2 is a cross-sectional view of base plate 11 along line 2—2 of FIG. 3. The Figure shows the recessed groove formed by ring locking section 14, in conjunction with flange section 16 and base section 12. The tapered nature of flange section 16, which facilitates forcing snap ring 18 over the flange section can be seen. The angle of the taper, which is relatively unimportant, may be varied as desired so long as it is steep enough to assist in the process of fastener assembly. The segmenting slots 22 are also illustrated, as is the upper and lower axial holes, 28 and 30, respectively, the different diameters of which form ledge seat 26 on which the heat of the anchor fastener attaching the base plate 11 to the roofing structure. Also to be observed in the Figure is the thickened, tapered nature of base section 12 and reinforcing ring section 32, which are designed to reduce "cupping" tendencies of the base plate 12. During the process of installation, installers sometimes overtighten the anchor fastener, causing the outer edge of base section 12 to be forced upwards. This cupping produces an upward force against the retaining component, snap ring 18, resulting in an insecure locking relationship between the ring and base plate 11 which sometimes causes dislodgement of the ring. The thickened, tapered conformation of the base section 12 greatly assists in overcoming this tendency. Furthermore, the anti-cupping characteristics imparted by the conformation of base section 12 can be considerably enhanced by provision of the reinforcing ring section 32 which adds greater mass to the base section, even further reducing any cupping tendencies which it might otherwise have.

Roofing membranes commonly come in thicknesses ranging from about 45 mil to approximately 90 mil. The clearance between the inner diameter of snap ring 18 and the maximum external diameter of flange section 16 will be designed to provide sufficient clearance to allow a roofing membrane to be interposed between the snap ring and the flange section so that the snap ring can be forced over the flange, compressing segments 24 in the process, in order to enable the snap ring to be positioned adjacent ring locking section 14. Frequently, however, the greatest external diameter of flange section 16 will range from about $\frac{3}{4}$ to $1\frac{1}{4}$ inches, while the internal diameter of the snap ring 18 will at the same time vary from about 1 to 1 and $\frac{1}{2}$ inches. When such dimensions are employed, the greatest diameter of the base section 12 will vary from about 2 inches to 12 inches, and although the shape of the base section will ordinarily be round, a square or otherwise shaped base section could also be used. In connection with the dimensions suggested, the height of the flange section 16 may be from about $\frac{1}{8}$ to $\frac{3}{8}$ inch, again depending in part on the thickness of the membrane used. A base section 12 having a height of from about $\frac{1}{4}$ to $\frac{3}{4}$ inch, at its thickest part, has been found to provide significant anti-cupping characteristics, in the tapered configuration described. A reinforcing ring section 32 having a height of from about 1/16 to $\frac{1}{4}$ inch, and having an internal diameter of at least about $\frac{1}{2}$ inch will significantly contribute to the rigidity of base section 12, thus minimizing any cupping tendencies. The height of the ring locking section 14 will be chosen to accomodate the thickness of the snap ring 18, and will ordinarily be constructed to be from about 3/16 to 5/16 inch in height. The dimensions of the axial hole in the base plate will depend upon the nature of the anchor fastener employed; however, the upper, larger diameter portion of the hole, advantageously, will be from about $\frac{3}{8}$ to $\frac{3}{4}$ inch, while the diameter of the lower portion of the hole typically will be about $\frac{1}{4}$ inch in diameter.

FIG. 3 is a top view of base plate 11 showing base section 12, ring locking section 14, and flange section 16. The axial hole, including upper part 28, and lower part 30, the juncture of which forms ledge seat 26, may also be seen. Slots 22 subdividing the assembly to form segments 24 are positioned to divide the ring locking section 14 and flange section 16 shown into eight segments. The width of the slots 22 will depend upon considerations such as the number of segments 24 to be formed; however, such slots will commonly be from about 1/32 to 3/16 inch wide. Some latitude is permissable in the number of segments contained by the base plate 11, although it has been found that at least 7 such segments are required to obtain the compressability characteristics required to force snap ring 18 into a locking relationship with the base plate. Usually, from about 7 to 12 segments will be so employed.

Figure 4:
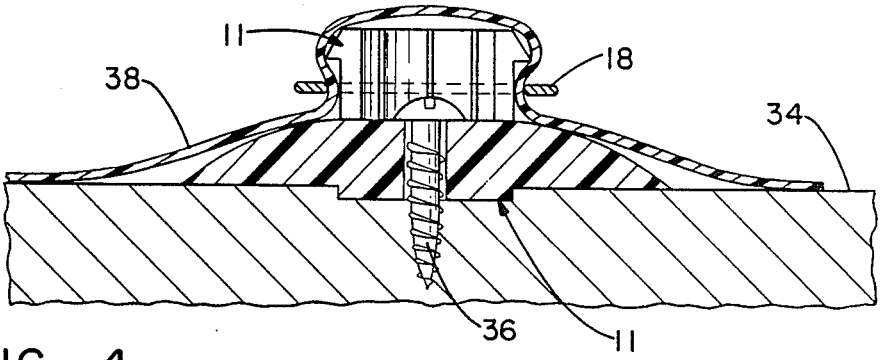
FIG. 4 is a sectional view of the base plate shown in FIG. 2, installed on a roofing structure and showing a snap ring securing a roofing membrane in place on the base plate.

FIG. 4 shows a sectional view of the base plate illustrated in FIG. 2 installed on a roofing structure 34. As shown, a base plate 11 is fastened to a roofing structure 34 by means of an anchor fastener 36, which in the Figure takes the form of a screw. When screws are so employed, it has been found that screws having lengths of from about 1 inch to 18 inches are effective for the purpose. Other types of fasteners might also be used. In FIG. 4 a roofing membrane 38 has been placed over base plate 11, and a snap ring 18 has been forced over the structure into a locking relationship therewith.

FIG. 5 shows a top view of a roofing structure over which a membrane 38 has been placed and locked into position with the membrane roofing fasteners 10 of the invention. In the Figure, the fasteners have been located in a square pattern; however, other patterns or configurations may also be used. Ordinarily, it is desirable to locate the roofing fasteners on centers ranging from about 3 to 17 feet apart.

Figure 6:
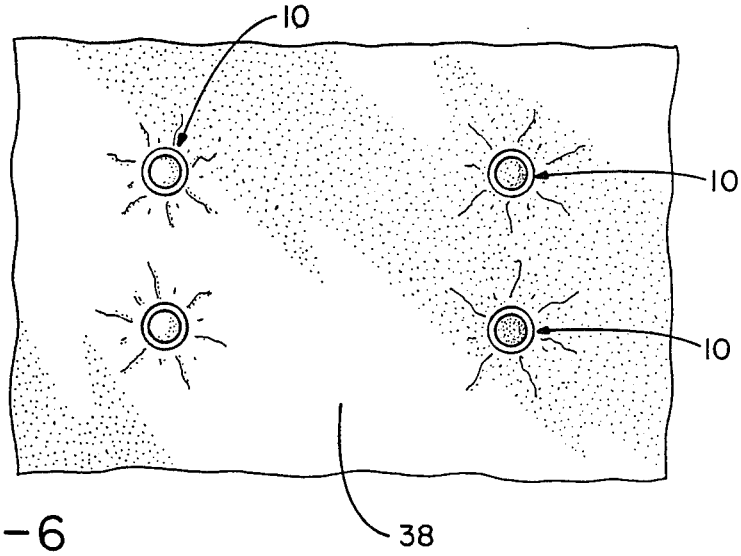
FIG. 6 is a partial cross-sectional view of an assembling tool designed for installation of the membrane roofing fasteners of the invention.
Figure 6:
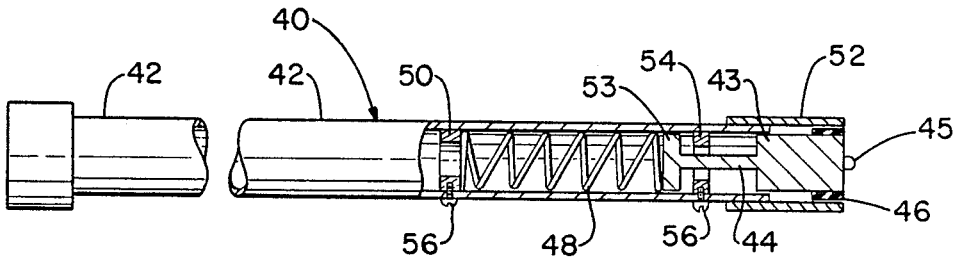

FIG. 6 shows a partial cross-section of an assembly tool 40 useful for installing snap rings 18 on base plates 11. As shown, assembly tool 40 comprises a tubular handle 42 in which a cylindrical piston 43 is inserted. The cylindrical piston 43, which has a locating nipple 45 on the face thereof, is attached by means of piston shank 44 to piston retaining means 53. The piston 43 is urged in a downward direction toward the open end of the tubular handle 42 by means of a spring 48, the upper end of which is maintained in position by spring stop 50. Cylindrical piston 43 is prevented from being forced out of assembly tool 40 by piston stop 54, which blocks piston retainer 53. In a preferred embodiment, an annular handle sleeve 52 is fixed to the open end of tubular handle 42. It has also been found to be of considerable advantage to provide the end of cylindrical piston 43 with an annular rubber sleeve 46. Tubular handle 42 is desirably made from plastic, while cylindrical piston 43 will ordinarily be made of metal to resist wear. Assembling tool 40 is used by positioning locating nipple 45 on top of a snap ring 18 placed on the roofing membrane over an upper axial hole 28. Tubular handle 42 is then pushed downward causing the lower edge of annular handle sleeve 52 to contact the snap ring, and push the latter downward over the tapered edge of flange section 16 into a locking relationship with ring locking section 14. The provision of annular rubber sleeve 46 serves to protect the roofing membrane from possible damage through contact with the edge of cylindrical piston 43. Spring stop 50 and piston 54 may be annular rings maintained in position by screws 56, although other equivalent means may be selected for such purpose if desired. In addition, the structure comprising the cylindrical piston 43, piston shank 44, and piston retainer 53 may be altered in various ways known in the art while still retaining the result desired, namely the slidable disposition of the cylindrical piston in the tubular handle 42, and the retention of the piston therein.

While in accordance with the patent statutes, a preferred embodiment and best mode has been presented, the scope of the invention is not limited thereto, but rather is measured by the scope of the attached claims.

What is claimed is:

1. A membrane roofing structure comprising:

a base plate, and a snap ring, said base plate comprising a unitary structure having a segmented, upper, tapered, circular flange section, a segmented, middle, circular ring-locking section, and a lower base section, said base plate having an axial hole therein, the one end of said hole of having a smaller internal diameter than the other end of said hole, and said snap ring comprising a flat ring having a rounded internal edge, the internal diameter of said snap ring being just large enough to fit over said flange section when the latter is compressed and covered with a roofing membrane, but not large enough to so fit when said flange section is not compressed.

2. The membrane roofing structure according to claim 1 in which said lower base section has a circular shape with an upper surface which tapers outwardly and downwardly from the juncture of said upper surface with said ring-locking section, to the horizontal surface of said lower base section having the greatest diameter.

3. The membrane roofing fastener according to claim 2 in which the lower horizontal surface of said base section includes as a part thereof an annular reinforcing ring section coaxial with said axial hole, and extending downward from said lower horizontal surface.

4. The membrane roofing fastener according to claim 1 whose base plate can be fastened to a roof structure with a headed anchor fastener the head of which is adapted to seat in the axial hole where the portions thereof having different diameters meet.

5. The membrane roof assembly in which an elastomeric roof membrane is fastened to a roof using membrane roofing fasteners according to claim 1.

6. The membrane roof assembly according to claim 5 in which said roofing membrane is an ethylene/-propylene/diene terpolymer.

7. The membrane roofing fastener according to claim 1 in which said base plate and snap ring are fabricated from plastic.

* * * * *